US005372367A

United States Patent [19]

McKendrick

[11] Patent Number: 5,372,367

[45] Date of Patent: Dec. 13, 1994

[54] GAME

[76] Inventor: Richard McKendrick, 14627 S. Helmer Rd., Battle Creek, Mich. 49017

[21] Appl. No.: 218,654

[22] Filed: Mar. 28, 1994

[51] Int. Cl.[5] ..... A63B 67/00

[52] U.S. Cl. ..... 273/346; 273/119 B; 273/356

[58] Field of Search ..... 273/346, 318, 352, 399, 273/119 B, 327, 337, 344, 345, 355, 356, 357, 347

[56] References Cited

U.S. PATENT DOCUMENTS

| | | | |
|---|---|---|---|
| 943,472 | 12/1909 | Schreiber et al. | 273/119 B |
| 2,270,566 | 1/1942 | Shue | 273/119 B |
| 3,211,097 | 1/1965 | Begley | 273/357 |
| 3,388,696 | 6/1968 | Hoverath et al. | 273/344 |
| 3,495,828 | 2/1970 | Kymla et al. | 273/357 |
| 3,685,828 | 8/1972 | Getgey et al. | 273/356 |
| 4,123,059 | 10/1978 | Gaibas | 273/356 |
| 4,186,927 | 2/1980 | Bkeslau et al. | 373/357 |
| 4,971,333 | 11/1990 | Baselli | 273/346 |
| 5,203,572 | 4/1993 | Lirn | 273/346 |
| 5,320,359 | 6/1994 | Harwell et al. | 273/346 |

FOREIGN PATENT DOCUMENTS

| | | | |
|---|---|---|---|
| 2826085 | 2/1979 | Germany | 273/356 |

*Primary Examiner*—Mark S. Graham

*Attorney, Agent, or Firm*—Flynn, Thiel, Boutell & Tanis

[57] ABSTRACT

A game having an elongated base with a finite length and a finite width. An upstanding target is provided at one end of the base while at least one projectile launching device is provided at the other end of the base. The projectile launching device includes a hollow bulbous member having an elastically yieldable wall and an opening in the wall into and out of which air can flow in response to an elastic yielding of the wall. At least one projectile is provided and has an elongated stem adapted to fit into the opening into the hollow bulbous member so that upon the ejection of air through the opening, the projectile will be launched toward the target. Structure is provided on the projectile and on a selected portion of the target for becoming attached to one another only in response to a mutual contact therebetween.

10 Claims, 1 Drawing Sheet

GAME

FIELD OF THE INVENTION

This invention relates to a game and, more particularly, to a game involving skill and manual dexterity.

BACKGROUND OF THE INVENTION

Youngsters and adults are often fascinated by the application of principles of physics. Particular enjoyment comes from the development of a skill level in a competitive game utilizing a player's ability at manual dexterity in controlling the principle of physics. One such principle of physics involves the utilization of compressed air to launch a projectile. A player's ability to control the degree of force generated by the compressed air when it is desired to launch a projectile is of particular interest and enjoyment.

Accordingly, it is an object of this invention to provide a game which involves a level of skill and the development of a level of manual dexterity for controlling an air force needed to launch a projectile toward a target.

It is a further object of this invention to provide a game, as aforesaid, utilizing a hollow bulbous member having an opening thereinto so as to allow air to flow into and out of the hollow bulbous member in response to a movement of an elastically yieldably wall section on the hollow bulbous member.

It is a further object of the invention to provide a projectile capable of being inserted into the opening of the hollow bulbous member and, when the hollow bulbous member is suddenly compressed, causes forced air to exit through the opening thereby launching the projectile toward the target.

It is a further object of the invention to provide a game and a projectile, as aforesaid, wherein the projectile has a blunted end and is, therefore, safe for people of all ages.

It is a further object of the invention to provide a game and a projectile, as aforesaid, wherein the components of the game can be enclosed into a carrying case which, when opened, orient an upstanding target at one end of a base and plural projectile launching devices at the other end of the base.

It is a further object of the invention to provide a game and a projectile, as aforesaid, wherein the projectile can be appropriately aimed at selected portions of an upstanding target.

It is a further object of the invention to provide a game and a projectile, as aforesaid, which is durable and safe to use.

SUMMARY OF THE INVENTION

In general, the objects and purposes of the invention are met by providing a game having an elongated base with a finite length and a finite width. An upstanding target is provided at one end of the base while at least one projectile launching device is provided at the other end of the base. The projectile launching device includes a hollow bulbous member having an elastically yieldable wall and an opening in the wall into and out of which air can flow in response to an elastic yielding of the wall. At least one projectile is provided and has an elongated stem adapted to fit into the opening into the hollow bulbous member so that upon the ejection of air through the opening, the projectile will be launched toward the target. Structure is provided on the projectile and on a selected portion of the target for becoming attached to one another only in response to a mutual contact therebetween.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figures 1, 2, 3:
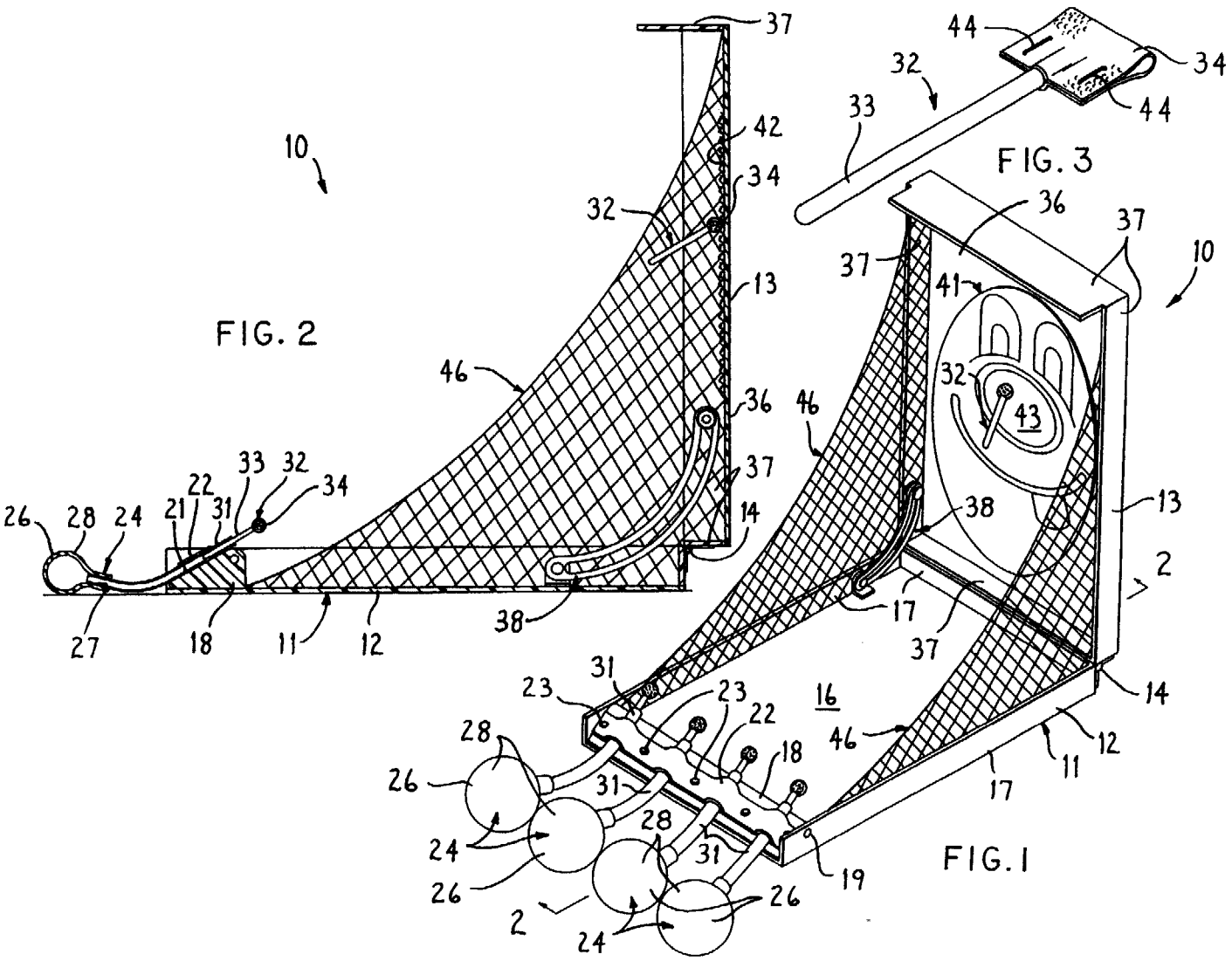
FIG. 1 is an isometric view of a game embodying the invention.
FIG. 2 is a sectional view taken along the line 2—2 of FIG. 1.
FIG. 3 is an isometric view illustrating an example of a projectile.

A game 10 embodying the invention is illustrated in FIGS. 1 and 2. The game 10 includes a two-part carrying case 11 defined by a base 12 and a cover 13. The base 12 and the cover 13 are interconnected by a hinge 14. The base 12 is generally a rectangularly-shaped receptacle having a bottom wall 16 and three upstanding sidewalls 17 joined to the bottom wall at the perimeter thereof. A fourth upstanding sidewall 18 is parallel to and located at an end of the bottom wall remote from the hinge 14. The hinge 14 is secured to one of the sidewalls 17 remote from the sidewall 18. In this particular embodiment, the sidewall 18 is secured to and extends between two of the laterally spaced sidewalls 17 by a conventional fastener 19, such as a screw or rivet.

The upper surface 21 of the sidewall 18 is upwardly inclined at an acute angle to a plane of the bottom wall 16 as best illustrated in FIG. 2. An elongated strand of elastically yieldable material 22 is secured to the upper surface 21 by a plurality of fasteners 23, such as screws or rivets. The elongated strand of elastically yieldable material can include, for example, a strand of rubber or the like. The lateral spacing between the fasteners 23 define locations whereat projectile launching devices 24 are to be located.

More specifically, FIG. 1 illustrates that four such projectile launching devices 24 are provided in a side-by-side arrangement. Each projectile launching device 24 includes a hollow bulbous member 26, which bulbous member has an opening 27 in a wall thereof. Air is permitted to move into and out of the interior of the bulbous member 26 in response to a movement of an elastically yieldable wall 28 of the bulbous member 26. In this particular embodiment, an elongated section of hollow tubing 29 is inserted into the opening 27. An opposite end 31 of the hollow tubing 29 is inserted between the strand of elastically yieldable material 22 and the upper surface 21 of the sidewall 18 and between laterally spaced pairs of fasteners 23. The elastically yieldable material 22 allows for a relative movement to occur between the end 31 of the hollow tubing 29 and the upper surface 21 of the sidewall 18. Further, the inclined surface 21 causes the axis of the end 31 of the tubing to be also upwardly inclined.

A projectile 32 is provided which has an elongated stem 33 and one part 34 of a two-part fastening structure generally marketed under the trademark Velcro. The Velcro hook or loop fastening structure on the projectile is constituted by one part of a pair of synthetic materials which adhere in a known manner when pressed together. The elongated stem 33 is of a diameter that is just slightly less than the internal diameter of the hollow tubing 29 so as to facilitate an insertion of the stem thereinto. Thus, a rapid compression of the hollow bulbous member 26 will cause a jet of air to be ejected from the interior of the bulbous member 26 out through the interior of the hollow tubing to thereby effect a launching of the projectile 32.

The cover 13 also includes a generally rectangularly-shaped receptacle having a bottom wall 36 and plural sidewalls 37 connected to the bottom wall 36 adjacent the perimeter thereof. The hinge 14 is secured to one of the sidewalls 37 as illustrated in FIGS. 1 and 2. In this particular embodiment, the bottom wall 36 is pivotal between a first position wherein the plane of the bottom wall 36 is generally parallel to the plane of the bottom wall 16 and a second position wherein the plane of the bottom wall 36 is oriented generally perpendicular to the plane of the bottom wall 16. A conventional slide and stop mechanism 38 interconnects a sidewall 17 on the base 12 to a sidewall 37 on the cover 13 as illustrated in FIGS. 1 and 2.

As is illustrated in FIG. 1, the inside facing surface of the bottom wall 36 on the cover 13 has a two-dimensional art form 41 thereon in the form of a face of a silly looking humanoid. Selected portions of the art form 41 have adhesively applied thereto the second part 42 of the two-part Velcro fastening structure which facilitates a coupling of the first part material 34 of the projectile 32 to the second part material 42 on the cover 13 when the two parts are pressed together. In this particular embodiment, the selected target portion is a two-dimensional art form illustrating an enlarged nostril 43 on the face of the aforementioned humanoid art form 41. Other portions of the art form can also have the second part material 42 applied thereto, such as the eyes and/or the tongue.

As illustrated in FIGS. 1 and 2, one such projectile 32 and the first part 34 of the two-part Velcro fastening structure is shown to be engaged with second part 42 of the Velcro fastening structure. It is also within the scope of this invention to make the entire art form 41 out of the second part of the Velcro fastening structure material, different portions of the facial expression being of differing colors so as to facilitate the assignment of points based on the location whereat the projectile strikes the target.

An example of a projectile 32 is illustrated in FIG. 3. In this particular embodiment, a flat section of a first part of a two-part Velcro fastening material is secured as by means of staples or the like. If desired, the material 34 can be adhesively secured to the stem 32.

The game is played by one or more individuals, each of which is assigned a hollow bulbous member 26 and one or more projectiles 32. If desired, the hollow bulbous members 26 can be of differing colors as can the projectiles 32 so as to enable a distinguishing of the players' projectiles and playing positions from one another. A player simply aims the projectile trajectory and thereafter uses his or her hand to rapidly compress the elastically yieldable wall 28 of the hollow bulbous member 26 to effect a launching of the projectile 32 toward a desired selected portion of the target art form 41.

The projectiles 32 are prevented from exiting the region of the game by a collapsible barrier 46 in the form of a nylon mesh fastened by any conventional means to the base 12 and cover 13 but only along the lateral sides thereof as shown in FIG. 1.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A game of skill and manual dexterity, comprising:

an elongated base having a finite length and width; means for defining an upstanding target on said base and at a first end of said base;

at least one projectile launching means mounted on said base at a second end thereof remote from said first end, said projectile launching means including a hollow bulbous member having an elastically yieldable wall and means defining an opening in said wall into and out of which air will flow in response to an elastic yielding of said wall, said opening having a first internal diameter;

at least one projectile, said projectile having an elongated stem having a second external diameter less than said first internal diameter, said stem being adapted to be inserted into said opening; and means on said projectile on an end thereof remote from said stem and on a selected portion of said target for becoming attached to one another only in response to an initial contact therebetween.

2. The game according to Claim 1, wherein said means defining an opening into said hollow bulbous member includes an elongated section of hollow tubing, into an end of said hollow tubing remote from said hollow bulbous member said stem on said projectile is received.

3. The game according to Claim 2, wherein said second end of said base includes a means for fastening said end of said hollow tubing remote from said hollow bulbous member thereto while simultaneously permitting a movement of said hollow tubing relative to said base to facilitate an aiming of said projectile at said selected portion of said target.

4. The game according to Claim 3, wherein said means for fastening includes an elongated strand of elastically yieldable material which is fixedly fastened to said base, said end of said hollow tubing being received between a stretched section of said strand and said base to be clamped therebetween.

5. The game according to Claim 3, wherein said base and said upstanding target both include generally planar sections which are connected to one another by a hinge, said planar target section being moveable between a first position generally parallel to said planar section of said base and a second position generally perpendicular thereto, said base and said target in said first position defining an enclosed carrying case.

6. The game according to Claim 5, wherein said target is maintained fixed in said second position by a stop mechanism.

7. The game according to Claim 3, wherein opposite lateral sides of said base and said upstanding target each include a collapsible barrier to assist in keeping projected projectiles therebetween.

8. The game according to Claim 1, wherein said means on an end of said projectile remote from said stem and on said selected portion of said target are synthetic materials which adhere when pressed together.

9. The game according to Claim 1, wherein said target is a two-dimensional art form having a general appearance of a face of a humanoid and said selected portion of said target is an enlarged nostril on said face.

10. The game according to Claim 1, wherein at least three projectile launching means are mounted side-by-side at said second end of said base.

* * * * *